US005428374A

United States Patent [19]

Kim

[11] Patent Number: 5,428,374

[45] Date of Patent: Jun. 27, 1995

[54] THERMAL TRANSFER PRINTER HAVING A TRANSPARENT TUBE FOR PRESSING AN INK FILM AND A PAPER SHEET

[75] Inventor: Wan-ha Kim, Suwon, Rep. of Korea

[73] Assignee: Samsung Electronics Co., Ltd., Kyungki-Do, Rep. of Korea

[21] Appl. No.: 314,384

[22] Filed: Sep. 28, 1994

[30] Foreign Application Priority Data

Sep. 29, 1993 [KR] Rep. of Korea ..... 1993-20551

[51] Int. Cl.[6] ..... B41J 2/44; B41J 2/447; B41J 2/435

[52] U.S. Cl. ..... 347/264; 347/215

[58] Field of Search ..... 346/76 L, 107 R, 108, 346/138; 400/55

[56] References Cited

U.S. PATENT DOCUMENTS 5,045,866 9/1991 Chiba et al. ..... 346/76 PH 5,339,132 8/1994 Tomita et al. ..... 346/107 R

FOREIGN PATENT DOCUMENTS 05729 6/1989 WIPO ..... 346/138

*Primary Examiner*—Huan H. Tran

*Attorney, Agent, or Firm*—Sughrue, Mion, Zinn, Macpeak & Seas

[57] ABSTRACT

A thermal transfer printer includes a rotating drum for transporting a sheet of paper together with and at the periphery of the drum, a plurality of guide rollers for guiding the paper sheet disposed on the periphery of the drum and rotated while in contact with the drum, an ink film which moves with the paper sheet, and a thermal transfer printing head for heating the ink film by irradiating light modulated according to image data so that the ink of the ink film is transferred onto the paper sheet. The printer further includes a tube for pressing the ink film and paper sheet against the drum, the tube containing the printing head therein and being formed of a transparent material, and a device for supporting the tube so that the tube comes into contact with the drum. In the above printer, it is possible to print image data on the entire paper sheet without producing margins in the upper and lower portions of the paper sheet, to precisely transport the paper sheet, and to keep the distance between the laser head and the ink film constant, thereby preventing the wasting of paper and obtaining a clear picture.

4 Claims, 5 Drawing Sheets

THERMAL TRANSFER PRINTER HAVING A TRANSPARENT TUBE FOR PRESSING AN INK FILM AND A PAPER SHEET

BACKGROUND OF THE INVENTION

1. Field of the Invention

The present invention relates to a printer and, more particularly, to a thermal transfer printer operative to prevent the generation of margins in the upper and lower portions of a sheet of paper, and in which a clearly printed picture can be obtained.

2. Description of the Related Art

A conventional laser printer, which is a type of the thermal transfer printer, comprises a laser head for converting image data into a laser beam and an ink film located below the laser head and holding an ink supply. Using the laser head and ink film, the laser printer carries out printing onto a sheet of paper disposed below the ink film.

In a color laser printer, three resolved images of yellow, magenta and cyan are sequentially printed on a sheet of paper to accomplish full coloring of a completed picture. That is, the paper sheet is printed by the sublimation of ink from the ink film which is heated by the laser beam from the laser head. The printed matter resulting from the color laser printer is extremely sharp. Therefore, the laser printer can be used for various applications. For example, after inputting image data into a computer by an image input device such as a scanner, a newly contrived picture can be created by revising and/or combining the input data according to a computer program and then may be outputted. Also, imaginary scenes and objects created with computer graphics, or the images of an electron microscope may be outputted using the laser printer. As this type of laser printer now tends to be used in lieu of photography in many fields, the printer should have the same quality and form as a photograph.

FIG. 1 illustrates a printing state on a sheet of paper by a conventional printer. As can be seen, a picture 1 is printed on the paper sheet producing margins 2 in the upper and lower portions of the paper sheet.

The causes of the problem of margins will be described hereinafter taking a conventional platen-type printer as an example.

FIG. 2 shows a side view for illustrating a printing operation by a conventional platen-type printer. As can be seen, a sheet of paper 9 supplied from a cassette 13 by a cam 14 passes between a pair of supplying rollers 12 and is transported according to the rotation of a drum 15 while contacting the drum by guide rollers 6 and 7 installed around the periphery of the drum. Paper sheet 9 is transported until the leading edge thereof reaches a guide roller 8 beyond the lower portion of a laser head 10 so that the paper sheet does not become separated from drum 15 during printing. Then, image data is printed on paper sheet 9 by laser head 10 and an ink film 4. Accordingly, a margin equal to a distance D measured from an initial printing position 16 to guide roller 8 is created in the leading edge portion of paper sheet 9. Further, it is difficult to maintain a consistent gap between a luminous element 11 positioned at a lower portion of laser head 10 and the ink film 4, and to precisely transport the paper sheet by the rotation of drum 15 only, which may result in a printed picture of poor clarity and sharpness.

The above-described margins in printed paper sheets and unclear printing causes a low quality appearance in the printed output, thereby resulting in the wasted paper due to the scrapping of poor prints.

SUMMARY OF THE INVENTION

It is an object of the present invention to provide a thermal printer operative to print image data on the entire paper sheet without creating margins in the upper and lower portions of the paper sheet, and in which a clearly printed picture can be obtained by maintaining a constant distance between a luminous element of a laser head and an ink film and by precisely transporting the paper sheet.

To accomplish the above object, a thermal transfer printer according to the present invention comprises a rotating drum for transporting a sheet of paper together with and at the periphery of the drum, a plurality of guide rollers, for guiding the paper sheet, disposed on the periphery of the drum and rotated while in contact with the drum, an ink film which moves with and over the paper sheet, and a thermal transfer printing head for heating the ink film by irradiating light modulated according to image data so that the ink of the ink film is transferred onto the paper sheet. The printer further comprises a tube for pressing the ink film and paper sheet against the drum, the tube containing at least a portion of the printing head therein and comprising a transparent material, and a device for supporting the tube so that the tube is rotated while in contact with the drum.

BRIEF DESCRIPTION OF THE DRAWINGS

The above objects and advantages of the present invention will become more apparent by describing in detail a preferred embodiment thereof with reference to the accompanying drawings in which.

DETAILED DESCRIPTION OF THE PREFERRED EMBODIMENT

A preferred embodiment of the present invention will be described hereinbelow with reference to the accompanying drawings.

Figure 1:
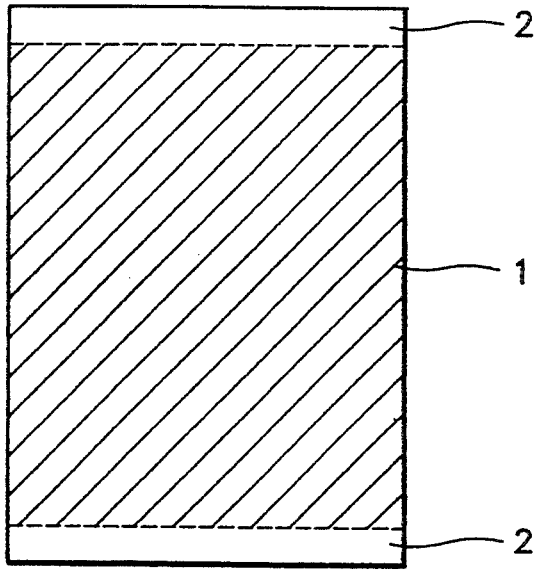
FIG.1 (PRIOR ART)
FIG. 1 illustrates a printing state on a paper sheet by a conventional printer.
Figure 2:
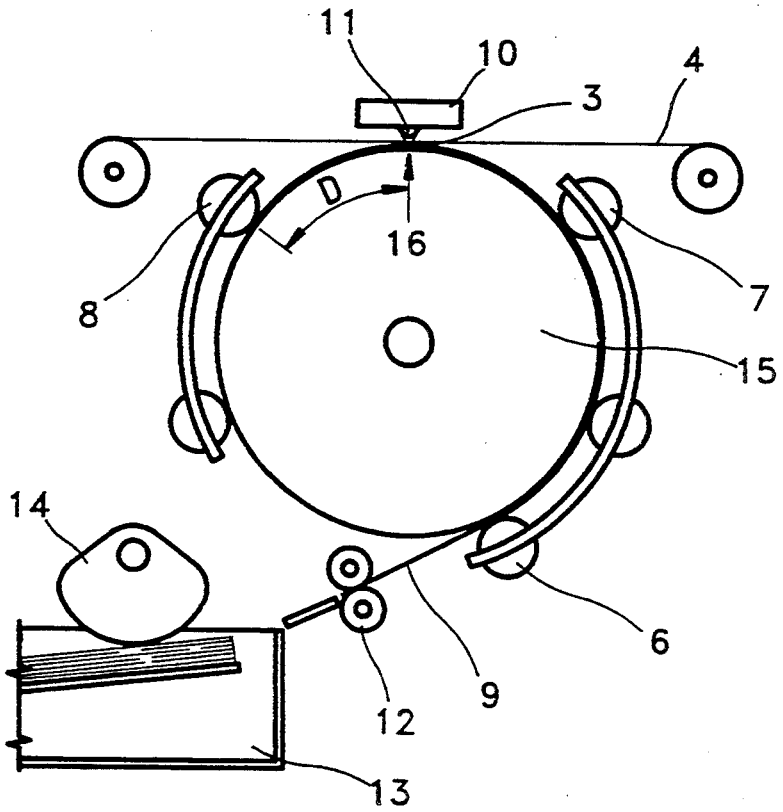
FIG.2 (PRIOR ART)
FIG. 2 shows a side view for illustrating the operation of a conventional platen-type printer.
Figure 3:
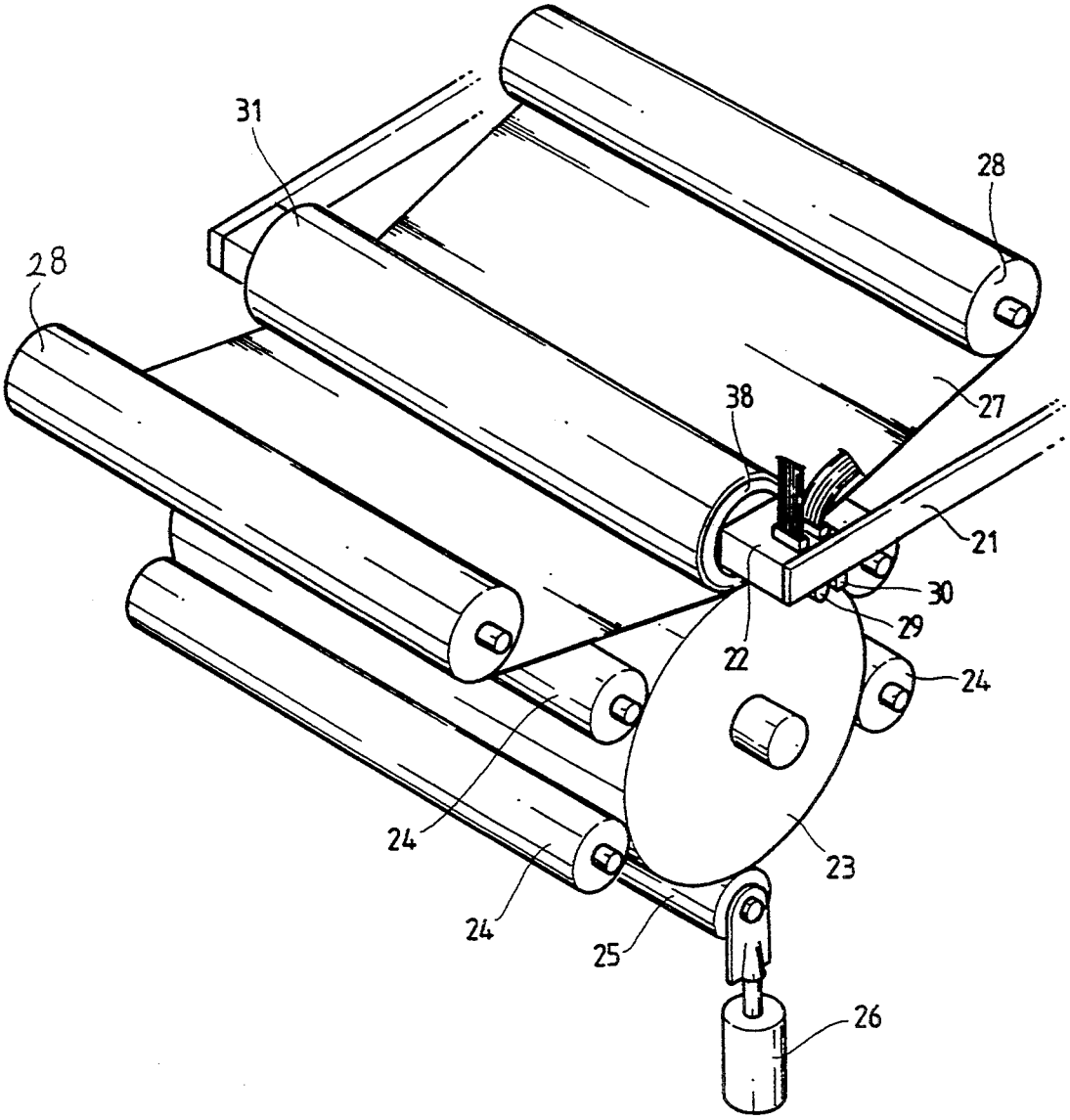
FIG. 3 shows a perspective view of a thermal transfer printer according to the present invention.

FIG. 3 shows a perspective view of a thermal transfer printer according to the present invention. As can be seen, a laser head 22 for transferring image data with a laser beam is encased by a transparent tube 31 positioned above drum 23 for precisely transporting a sheet of paper and for keeping a constant distance between laser head 22 and an ink film 27. Between laser head 22 and tube 31, a bearing 38 may be installed to rotatably support the tube 31. A sensor 30 is provided at a predetermined position on laser head 22 for detecting the leading and trailing edges of the paper sheet so that the paper sheet is printed from the leading edge to the trailing edge.

A lifter 21 is coupled to both ends of laser head 22 for raising and lowering tube 31 and laser head 22 and for bringing the tube 31 into contact with the drum 23. The ink film 27 bearing three colors, i.e., yellow, magenta and cyan, in sequence is conveyed below laser head 22, between ink film reels 28 provided on both sides of the tube. A plurality of guide rollers 24 are installed around the periphery of drum 23 for bringing the paper sheet into contact with the drum.

Below drum 23, a supply/discharge roller 25 is installed to contact the drum during a paper supplying 15 operation, and to separate from the drum during a paper discharging operation. Supplying-discharging roller 25 is actuated by a solenoid 26 installed at one side thereof.

Figure 4:
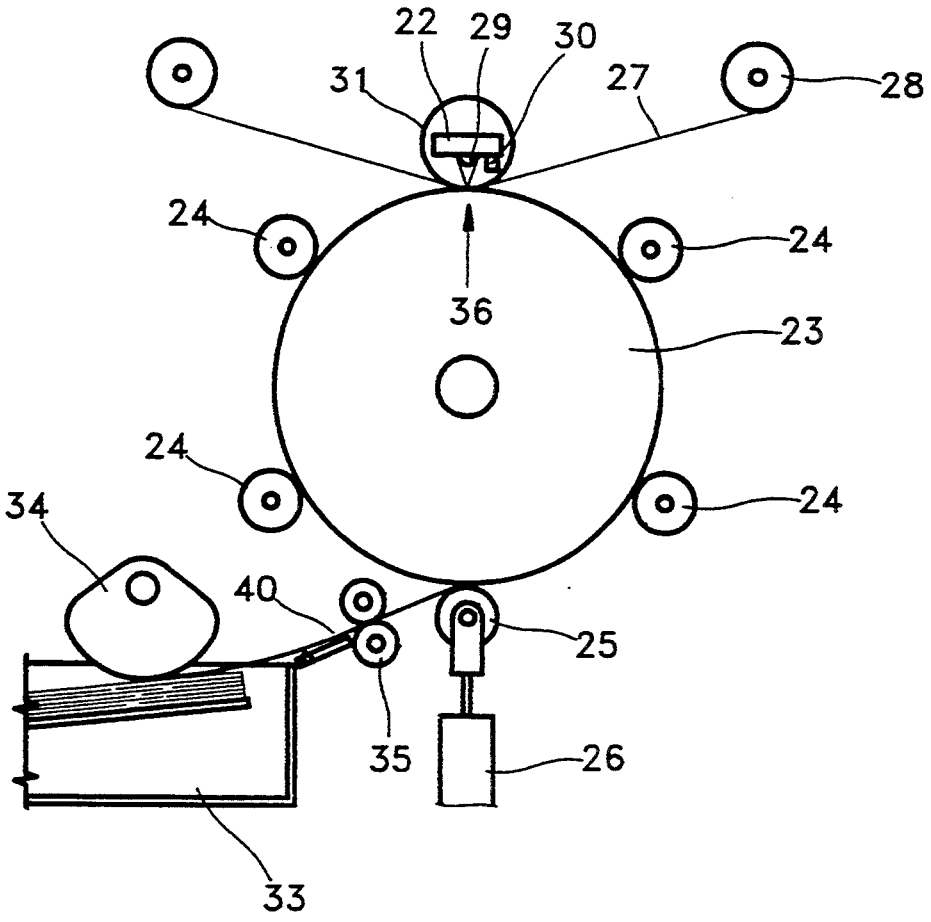
FIG. 4 shows a side view of the thermal transfer printer according to the present invention, for illustrating the state in which a sheet of paper is supplied between a drum and a supplying-discharging roller.

As shown in FIG. 4, a cassette 33 for storing paper sheets therein is installed in front of the drum 23. The cassette 33 is provided with a cam 34 for supplying single sheets of paper from the cassette towards drum 23. Between cassette 33 and drum 23, a pair of supplying rollers 35 are installed to transport the paper sheet between the drum and supply/discharge roller 25.

The operation of the thermal transfer printer according to the present invention will be hereinbelow described.

As shown in FIG. 4, a sheet of paper 40 is supplied by cam 34 from the cassette 33 and is inserted between the drum 23 and supplying-discharging roller 25 via supplying rollers 35. Paper sheet 40 is transported together with at the periphery of drum 23 according to the rotation of the drum. At this time, the paper sheet comes into contact with the drum by guide rollers 24 installed around the periphery of the drum 23.

Figure 5:
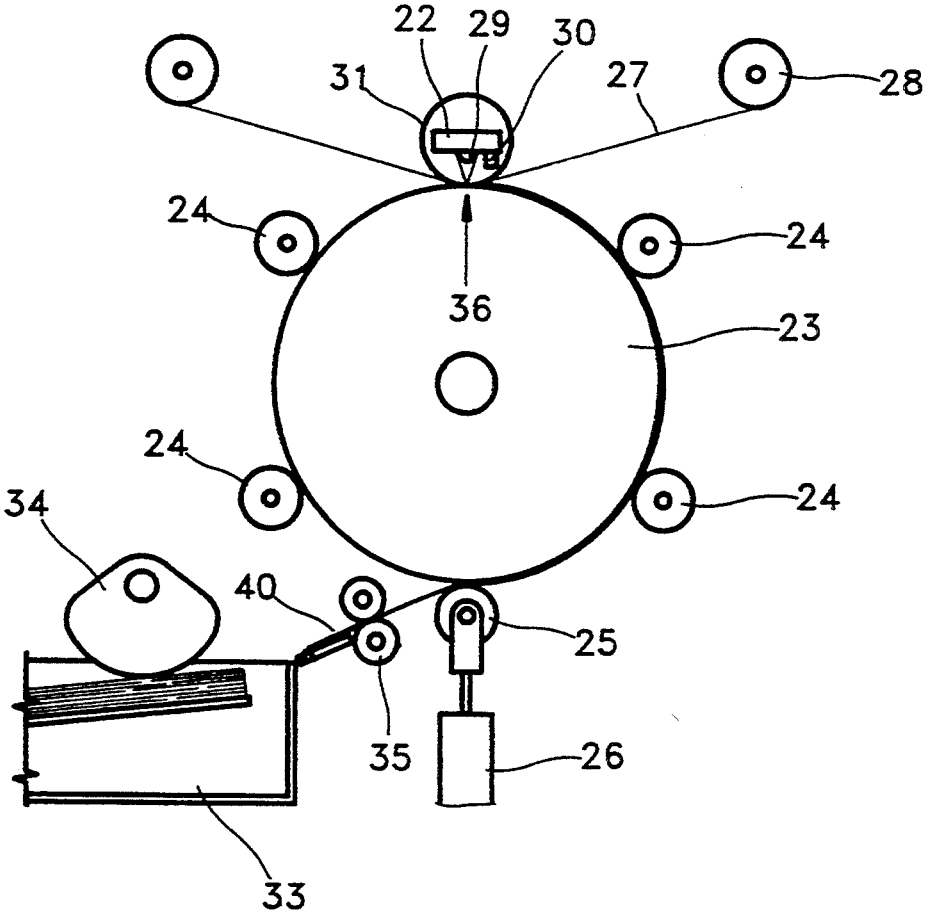
FIG. 5 shows a side view of the thermal transfer printer according to the present invention, for illustrating the state which the paper sheet reaches an initial position.

FIG. 5 shows a side view of the thermal transfer printer according to the present invention, for illustrating the state in which the paper sheet 40 reaches an initial position.

As shown in FIG. 5, when the leading edge of the paper sheet reaches an initial printing position 36, the leading edge is detected by sensor 30 installed at a predetermined position on laser head 22. At the same time, laser head 22 irradiates a laser beam to print image data on the paper sheet. At this time, tube 31 functions to keep the distance between laser head 22 and ink film 27 constant, and to precisely transport the paper sheet while rotating smoothly without obstructing the rotation of the drum 23. When the trailing edge of the paper sheet reaches the initial printing position 36, the first sensor 30 detects the trailing edge of the paper sheet so that printing is stopped. Then, the drum 23 rotates until the leading edge of the paper sheet 40 reaches the initial printing position again. The next two colors are printed on the paper sheet in the same method as the first color.

Figure 6:
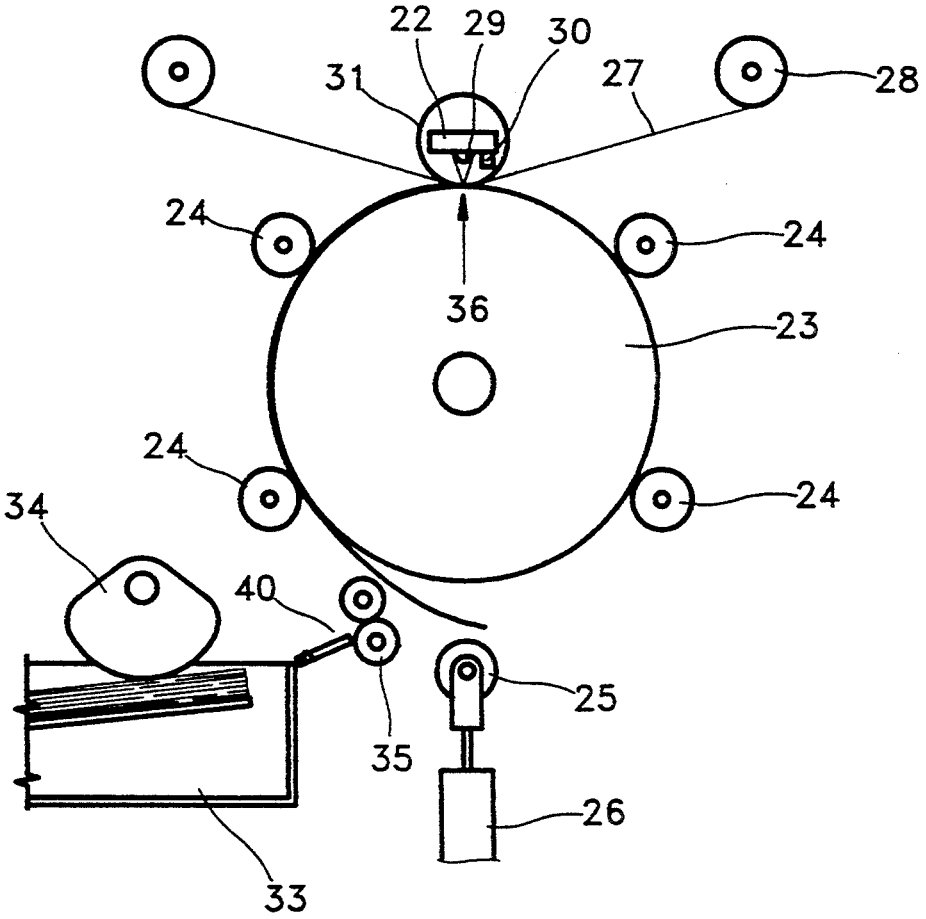
FIG. 6 shows a side view of the thermal transfer printer according to the present invention, for illustrating a discharging state of the paper sheet after completing the printing of the last color.

As shown in FIG. 6, after the printing of the last color is completed, when the leading edge of the paper sheet reaches supplying-discharging roller 25, the supplying-discharging roller 25, which is in contact with drum 23, is lowered by operation of the solenoid 26 to become separated from the drum so that the printed paper sheet 40 can be discharged.

On the other hand, sensor 30 may be installed at any location, as long as the sensor can detect whether the leading and trailing edges of the paper sheet reach the initial printing position so as to control the printing operation of the printer.

As described above, in the thermal transfer printer according to the present invention, it is possible to print image data on the entire paper sheet without producing margins in the upper and lower portions of the paper sheet, thereby preventing the wasting of paper. Also, it is possible to precisely transport the paper sheet, and to keep the distance between the printing head and the ink film constant, to thereby obtain a clear picture.

It is contemplated that numerous modifications may be made to the thermal transfer printer of the present invention without departing from the spirit and scope of the invention as defined in the following claims.

What is claimed is:

1. A thermal transfer printer comprising: a rotating drum for transporting a paper sheet together with and at a periphery of said drum; a plurality of guide rollers, for guiding the paper sheet, disposed on the periphery of said drum and rotated while in contact with said drum; an ink film containing ink and which moves with the paper sheet and passes over the paper sheet; and a printing head for heating said ink film by irradiating light modulated according to image data so that the ink of said ink film is transferred onto the paper sheet, said thermal transfer printer further comprising a transparent tube for pressing said ink film and the paper sheet against said drum, said transparent tube containing at least a portion of said printing head therein and being formed of a transparent material; and a device for supporting said transparent tube so that said transparent tube comes into contact with said drum.

2. The thermal transfer printer as claimed in claim 1, further comprising a bearing, installed between said printing head and transparent tube, for permitting rotation of said transparent tube according to movement of said ink film.

3. The thermal transfer printer as claimed in claim 1, further comprising at least one sensor, installed at the periphery of said drum, for detecting at least one of a leading edge and a trailing edge of the paper sheet so that the paper sheet is printed from the leading edge to the trailing edge thereof.

4. The thermal transfer printer as claimed in claim 3, wherein said at least one sensor is installed at a predetermined position on said printing head.

* * * * *